US011377748B2

(12) United States Patent
Engelhardt et al.

(10) Patent No.: US 11,377,748 B2
(45) Date of Patent: Jul. 5, 2022

(54) COMPOSITION FOR COBALT ELECTROPLATING COMPRISING LEVELING AGENT

(71) Applicant: BASF SE, Ludwigshafen am Rhein (DE)

(72) Inventors: Nadine Engelhardt, Ludwigshafen (DE); Dieter Mayer, Ludwigshafen (DE); Marco Arnold, Ludwigshafen (DE); Alexander Fluegel, Ludwigshafen (DE); Charlotte Emnet, Ludwigshafen (DE); Lucas Benjamin Henderson, Ludwigshafen (DE)

(73) Assignee: BASF SE, Ludwigshafen am Rhein (DE)

( * ) Notice: Subject to any disclaimer, the term of this patent is extended or adjusted under 35 U.S.C. 154(b) by 0 days.

(21) Appl. No.: 16/762,717

(22) PCT Filed: Nov. 19, 2018

(86) PCT No.: PCT/EP2018/081692
§ 371 (c)(1),
(2) Date: May 8, 2020

(87) PCT Pub. No.: WO2019/097044
PCT Pub. Date: May 23, 2019

(65) Prior Publication Data

US 2020/0347503 A1 Nov. 5, 2020

(30) Foreign Application Priority Data

Nov. 20, 2017 (EP) ..... 17202568

(51) Int. Cl.
*C25D 3/18* (2006.01)
*C25D 7/12* (2006.01)
*C25D 5/02* (2006.01)

(52) U.S. Cl.
CPC ..... *C25D 3/18* (2013.01); *C25D 5/02* (2013.01); *C25D 7/123* (2013.01)

(58) Field of Classification Search
CPC ..... C25D 3/12–18; C25D 7/12–123; H01L 21/76873
See application file for complete search history.

(56) References Cited

U.S. PATENT DOCUMENTS 3,753,872 A * 8/1973 Koehl ..... C25D 3/12 205/280
4,425,198 A 1/1984 Martin
6,193,789 B1 * 2/2001 Honma ..... H05K 3/384 106/1.23
2005/0163933 A1 7/2005 Dietsche et al.
2006/0251800 A1 * 11/2006 Weidman ..... H01L 23/53238 427/99.5
2007/0176149 A1 8/2007 Dietsche et al.
2008/0233390 A1 9/2008 Gothlich et al.
2009/0188805 A1 7/2009 Moffat et al.
2010/0175792 A1 7/2010 Dietsche et al.
2011/0163449 A1 7/2011 Kelly et al.
2014/0183738 A1 7/2014 Jezewski et al.
2015/0071980 A1 * 3/2015 Hobbs ..... B22F 1/0018 424/421
2016/0273117 A1 9/2016 Doubina et al.
2017/0154787 A1 6/2017 Sakashita et al.
2019/0010624 A1 * 1/2019 Commander ..... H01L 21/2885

FOREIGN PATENT DOCUMENTS

DE 10 2005 038 608 A1 2/2007
EP 1 323 848 A1 7/2003
GB 1 283 417 A 7/1972
GB 2 100 752 A 1/1983
WO WO 2004/074372 A1 9/2004
WO WO 2017/004424 A1 1/2017
WO WO 2018/015168 A1 1/2018
WO WO 2019/201623 A2 10/2019

OTHER PUBLICATIONS

U.S. Appl. No. 16/318,540, filed Jan. 17, 2019, Marcel Patrik Kienle et al.
International Search Report and Written Opinion dated Feb. 11, 2019 in PCT/EP2018/081692, citing documents AA, AB,AO-AR and AY therein, 5 pages.
Extended European Search Report dated Sep. 13, 2018 in corresponding European Patent Application No. 17202568.6 citing documents AA, AB,AO-AQ and AY therein, 5 pages.
T. Sugama, et al., "Advanced poly(acrylic)acid-modified zinc phosphate conversion coatings: use of cobalt and nickel cations", Surface and Coatings Technology, vol. 50, Issue 2, 1992, pp. 89-95.
C. H. Lee, et al., "Superconformal Electrodeposition of Co and Co—Fe Alloys Using 2-Mercapto-5-benzimidazolesulfonic Acid", Journal of the Electrochemical Society, vol. 156, Issue 8, Jun. 10, 2009, pp. D301-D309.

* cited by examiner

*Primary Examiner* — Harry D Wilkins, III
*Assistant Examiner* — Ho-Sung Chung
(74) *Attorney, Agent, or Firm* — Armstrong Teasdale LLP

(57) ABSTRACT

A cobalt electrodeposition composition comprising cobalt ions, and particular leveling agents comprising $X^1$—CO—O—$R^{11}$, $X^1$—$SO_2$—O—$R^{11}$, $X^1$—PO($OR^{11}$)$_2$, $X^1$—SO—O—$R^{11}$ functional groups, wherein $X^1$ is a divalent group selected from (i) a chemical bond (ii) aryl, (iii) $C_1$ to $C_{12}$ alkandiyl, which may be interrupted by O atoms, (iv) an arylalkyl group —$X^{11}$—$X^{12}$—, (v) an alkylaryl group —$X^{12}$—$X^{11}$—, and (vi) —(O—$C_2H_3R^{12}$)$_m$O—, $R^{11}$ is selected from H and $C_1$ to $C_4$ alkyl. $R^{12}$ is selected from H and $C_1$ to $C_4$ alkyl, $X^{12}$ is a divalent aryl group, $X^{11}$ is a divalent $C_1$ to $C_{15}$ alkandiyl group.

12 Claims, No Drawings

COMPOSITION FOR COBALT ELECTROPLATING COMPRISING LEVELING AGENT

The present invention relates to a composition for cobalt electroplating comprising cobalt ions and a leveling agent.

BACKGROUND OF THE INVENTION

Filling of small features, such as vias and trenches, by metal electroplating is an essential part of the semiconductor manufacture process. It is well known, that the presence of organic substances as additives in the electroplating bath can be crucial in achieving a uniform metal deposit on a substrate surface and in avoiding defects, such as voids and seams, within the metal lines.

With further decreasing aperture size of recessed features like vias or trenches the filling of the interconnects with copper becomes especially challenging, also since the copper seed deposition by physical vapor deposition (PVD) prior to the copper electrodeposition might exhibit inhomogeneity and non-conformity and thus further decreases the aperture sizes particularly at the top of the apertures. Furthermore, it becomes more and more interesting to substitute copper by cobalt since cobalt shows less electromigration into the dielectric.

For cobalt electroplating several additives were proposed to ensure void-free filling of submicrometer-sized features.

US 2011/0163449 A1 discloses a cobalt electrodeposition process using a bath comprising a cobalt deposition-inhibiting additive, such as saccharin, coumarin or polyethyleneimine (PEI).

US 2009/0188805 A1 discloses a cobalt electrodeposition process using a bath comprising at least one accelerating, inhibiting, or depolarizing additive selected from polyethyleneimine and 2-mercapto-5-benzimidazolesulfonic acid.

WO2017/004424 discloses a composition for cobalt electrodeposition comprising SPS as an accelerator, and an acetylenic suppressor like propargyl alcohol and alkoxylated propargyl alcohol.

PCT/EP2017/066896 discloses alkynoles and alkyne amines as suppressing agents.

EP 1323848 A1 discloses a nickel electroplating solution containing a) nickel ions, and b) at least two chelating agents selected from amino polycarboxylic acids, polycarboxylic acids, and polyphosphonic acids, wherein the nickel electroplating solution has a pH of 4 to 9, and a ratio of nickel ions to chloride ions ($Ni^{+2}/Cl^{-1}$) of 1 or less.

US 2016/273117 A1 discloses a method for electroplating cobalt into recessed features on a substrate, the method including: receiving the substrate in an electroplating chamber, the substrate including recessed features having a cobalt seed layer thereon, the cobalt seed layer having a thickness of about 50 A or less, and the recessed features having a width between about 10-150 nm, immersing the substrate in electrolyte, the electrolyte including boric acid, halide ions, cobalt ions, and organic additives for achieving seam-free bottom-up fill in the recessed features, and electroplating cobalt into the features under conditions that provide bottom-up fill.

The disadvantage of the existing cobalt electrodeposition baths is its strong mounding effect over dense features.

There is still a strong need for cobalt electroplating bath which provides, besides void-free filling of submicrometer-sized interconnect features, a substantially planar surface over the filled features.

It is therefore an object of the present invention to provide a cobalt electroplating additive having good leveling properties, in particular leveling agents capable of providing a substantially planar metal layer and filling features on the nanometer and on the micrometer scale without substantially forming defects, such as but not limited to voids, with a cobalt electroplating bath.

It is a further object of the present invention to provide a cobalt electroplating bath capable of depositing a low impurity metal layer.

SUMMARY OF THE INVENTION

With the particular vinylic, polyvinylic or aromatic leveling agents described below the present invention provides a new class of highly effective leveling agents that provide reduced mounding above recessed features fully filled with cobalt, particularly on substrates comprising nanometer-sized interconnect features, particularly if areas of different feature density and width are present.

Therefore, the present invention provides a composition comprising (a) metal ions consisting essentially of cobalt ions, and (b) a leveling agent comprising the structure of formula L1

$$[B]_n[A]_p \quad \text{(L1)}$$

or having the structure of Formula L2

(L2)

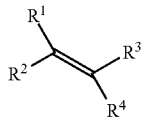

or comprising the structure of formula L3a or L3b (L3a)

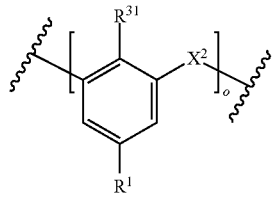

(L3b)

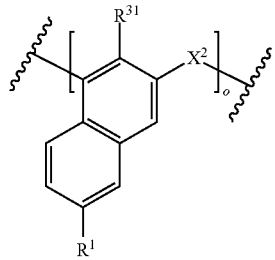

or having the structure of formula L4

$$Ø\text{-}R^1 \quad \text{(L4)}$$

and their salts, wherein $R^1$ is selected from $X^1—CO—O—R^{11}$, $X^1—SO_2—O—R^{11}$, $X^1—PO(OR^{11})_2$, $X^1—SO—O—R^{11}$;

$R^2$, $R^3$, $R^4$ are independently selected from $R^1$ and (i) H, (ii) aryl, (iii) $C_1$ to $C_{10}$ alkyl (iv) arylalkyl, (v) alkylaryl, and (vi) —$(O—C_2H_3R^{12})_m$—OH, with the proviso that if one of $R^2$, $R^3$ or $R^4$ are selected from $R^1$, the other groups $R^2$, $R^3$ or $R^4$ are different from $R^1$, Ø is a $C_6$ to $C_{14}$ carbocyclic or a $C_3$ to $C_{10}$ nitrogen or oxygen containing heterocyclic aryl group, which may be unsubstituted or substituted by up to three $C_1$ to $C_{12}$ alkyl groups or up to two OH, $NH_2$ or $NO_2$ groups, $R^{31}$ is selected from $R^1$, H, $OR^5$ and $R^5$, $R^{32}$ is selected from (i) H and (ii) $C_1$ to $C_6$ alkyl, $X^1$ is a divalent group selected from (i) a chemical bond (ii) aryl, (iii) $C_1$ to $C_{12}$ alkandiyl, which may be interrupted by O atoms, (iv) arylalkyl group —$X^{11}$—$X^{12}$—, (v) alkylaryl group —$X^{12}$—$X^{11}$—, and (vi) —$(O—C_2H_3R^{12})_m$O—, $X^2$ is (i) a chemical bond or (ii) methanediyl, $R^{11}$ is selected from H and $C_1$ to $C_4$ alkyl, $R^{12}$ is selected from H and $C_1$ to $C_4$ alkyl, $X^{12}$ is a divalent aryl group, $X^{11}$ is a divalent $C_1$ to $C_{15}$ alkandiyl group, A is a co-monomer selected from vinyl alcohol, which may optionally be (poly)ethyoxylated, and acrylamide, B is selected from formula L1a (L1a)

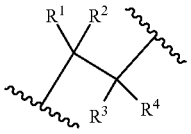

n is an integer from 2 to 10,000, m is an integer from 2 to 50, o is an integer from 2 to 1000, and p is 0 or an integer from 1 to 10,000, and wherein the composition is free of any dispersed particles.

In another embodiment the present invention provides a composition comprising (a) metal ions consisting essentially of cobalt ions, and (b) a leveling agent comprising the structure of formula L1

$$[B]_n[A]_p \quad (L1)$$

or having the structure of formula L2

(L2)

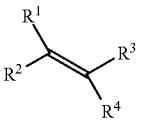

or comprising the structure of formula L3a or L3b (L3a)

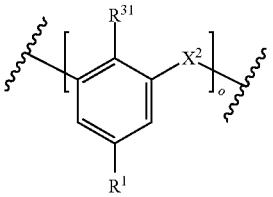

-continued (L3b)

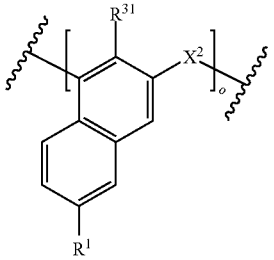

or having the structure of formula L4

$$Ø\text{-}R^1 \quad (L4)$$

and their salts, wherein $R^1$ is selected from $X^1$—CO—O—$R^{11}$, $X^1$—$SO_2$—O—$R^{11}$, $X^1$—$PO(OR^{11})_2$, $X^1$—SO—O—$R^{11}$;

$R^2$ is selected from (i) H, (ii) aryl, (iii) $C_1$ to $C_{10}$ alkyl (iv) arylalkyl, (v) alkylaryl, and (vi) —$(O—C_2H_3R^{12})_m$—OH, $R^3$ is selected from $R^1$ and $R^2$;

$R^4$ is selected from $R^2$ and, in case $R^3$ is $R^2$, $R^4$ may also be $R^1$, Ø is a $C_6$ to $C_{14}$ carbocyclic or a $C_3$ to $C_{10}$ nitrogen or oxygen containing heterocyclic aryl group, which may be unsubstituted or substituted by up to three $C_1$ to $C_{12}$ alkyl groups or up to two OH, $NH_2$ or $NO_2$ groups, $R^{31}$ is selected from $R^1$, H, $OR^5$ and $R^5$, $R^{32}$ is selected from (i) H and (ii) $C_1$ to $C_6$ alkyl, $X^1$ is a divalent group selected from (i) a chemical bond (ii) aryl, (iii) $C_1$ to $C_{12}$ alkandiyl, which may be interrupted by O atoms, (iv) arylalkyl group —$X^{11}$—$X^{12}$—, (v) alkylaryl group —$X^{12}$—$X^{11}$—, and (vi) —$(O—C_2H_3R^{12})_m$O—, $X^2$ is (i) a chemical bond or (ii) methanediyl, $R^{11}$ is selected from H and $C_1$ to $C_4$ alkyl, $R^{12}$ is selected from H and $C_1$ to $C_4$ alkyl, $X^{12}$ is a divalent aryl group, $X^{11}$ is a divalent $C_1$ to $C_{15}$ alkandiyl group, A is a co-monomer selected from vinyl alcohol, which may optionally be (poly)ethyoxylated, and acrylamide, B is selected from formula L1a (L1a)

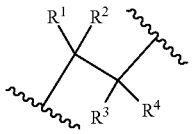

n is an integer from 2 to 10,000, m is an integer from 2 to 50, o is an integer from 2 to 1000, and p is 0 or an integer from 1 to 10,000, wherein the composition is free of any dispersed particles.

The invention further relates to the use of a metal plating bath comprising a composition as defined herein for depositing cobalt on substrates comprising recessed features having an aperture size of 100 nanometers or less, in particular 20 nm or less, 15 nm or less, or even 7 nm or less.

The invention further relates to a process for depositing a layer comprising cobalt on a substrate comprising features having an aperture size below 100 nm, preferably below 50 nm, by a) contacting a composition as defined herein with the substrate, and b) applying a current density to the substrate for a time sufficient to deposit a metal layer onto the substrate.

In this way additives are provided that result in less mounding on the wafer above the fully filled recessed features.

DETAILED DESCRIPTION OF THE INVENTION

The compositions according to the inventions comprise cobalt ions, and a leveling agent of formulas L1 to L4 as described below.

Leveling Agent According to the Invention

As used herein, "leveling agent" refers to an organic compound that is, besides any additional functionality, capable of providing a substantially planar metal layer on the substrate. The terms "leveler", "leveling agent" and "leveling additive" are used interchangeably throughout this specification.

In a first embodiment, the leveling agent to be used in the electroplating compositions comprises the polymeric structure of formula L1

$$[B]_n[A]_p \quad \text{(L1)}$$

In a second embodiment the leveling agent to be used in the electroplating compositions comprises the monomeric structure of formula L2

(L2)

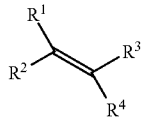

In a third embodiment the leveling agent to be used in the electroplating compositions comprises the polymeric structure of formula L3a or L3b (L3a)

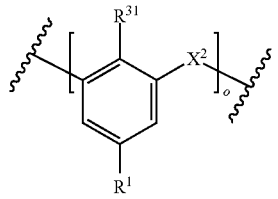

(L3b)

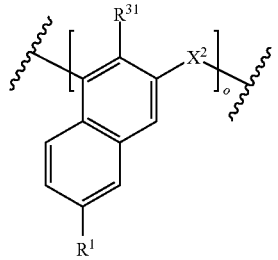

In a fourth embodiment the leveling agent to be used in the electroplating compositions comprises the monomeric structure of formula L4

$$Ø\text{-}R^1 \quad \text{(L4)}$$

with the substituents described below.

As used herein, "aryl" means a $C_6$ to $C_{14}$ carbocyclic or a $C_3$ to $C_{10}$ nitrogen or oxygen containing heterocyclic aromatic ring system, which may be unsubstituted or substituted by up to three $C_1$ to $C_{12}$ alkyl groups or up to two OH, $NH_2$ or $NO_2$ groups.

In all embodiments, $R^1$ in formulas L1 to L4 may be selected from $X^1$—CO—O—$R^{11}$, $X^1$—$SO_2$—O—$R^{11}$, $X^1$—$PO(OR^{11})_2$, and $X^1$—SO—$OR^{11}$. $R^1$ is also referred to herein as "functional group".

$X^1$ may be a chemical bond, which means that the functional groups —CO—O—$R^{11}$, —$SO_2$—O—$R^{11}$, —$PO(OR^{11})_2$ and —SO—$OR^{11}$ are directly bonded to the polymer backbone in formula L1, the vinyl group in formula L2 or the aromatic system in formulas L3a, L3b, and L4. As used herein, "chemical bond" means that the respective moiety is not present but that the adjacent moieties are bridged so as to form a direct chemical bond between these adjacent moieties. By way of example, if in X—Y—Z the moiety Y is a chemical bond then the adjacent moieties X and Z together form a group X—Z.

In an alternative $X^1$ is a divalent aryl group. Preferred divalent aryl groups are phenylene, naphthalene, pyridine, or imidazole, particularly 1,4-phenylene.

In a further alternative $X^1$ is a divalent $C_1$ to $C_{12}$ alkanediyl group, which may be interrupted by O atoms. As used herein, "$C_x$" means that the respective group comprises x numbers of C atoms. By way of example, the terms "$C_x$ to $C_y$ alkanediyl" and $C_x$ to $C_y$ alkyl mean alk(anedi)yl with a number x to y of carbon atoms and includes linear, branched (if $>C_3$) and cyclic alkanediyl (if $>C_4$).

In yet a further alternative $X^1$ is a divalent arylalkyl group —$X^{11}$—$X^{12}$—, wherein $X^{11}$ is a $C_1$ to $C_{15}$ alkandiyl group bonded to the polymer backbone, vinyl group, or aromatic system, respectively, and $X^{12}$ is a divalent aryl group bonded to the functional group. Preferred arylalkyl groups may be but are not limited to benzyl (ortho, meta or para form) and 1, 2, or 3-methylpyridine. Preferably the alkanediyl part $X^{11}$ may be methanediyl, propanediyl, or butanediyl. Preferably the aryl part $X^{12}$ may be phenylene, naphthalene, pyridine, or imidazole, particularly 1,4-phenylene.

In another alternative $X^1$ is a divalent alkylaryl group —$X^{12}$—$X^{11}$—, wherein $X^{12}$ is a divalent aryl group bonded to the polymer backbone, vinyl group, or aromatic system, respectively, and $X^{11}$ is a $C_1$ to $C_{15}$ alkandiyl group bonded to the functional group. Preferred arylalkyl groups may be but are not limited to toluyl (ortho, meta or para form) and 1, 2, or 3-methylpyridine. Preferably the alkanediyl part $X^{11}$ may be methanediyl, propanediyl, or butanediyl. Preferably the alkanediyl part $X^{11}$ may be phenylene, naphthalene, pyridine, or imidazole, particularly 1,4-phenylene.

In yet another alternative $X^1$ is a divalent (poly)alkylene oxide spacer —$(C_2H_3R^{12}$—$O)_m$—, wherein $R^{12}$ is selected from H and $C_1$ to $C_4$ alkyl, preferably H or methyl, and m is an integer from 1 to 10, preferably from 1 to 5.

Preferably, $X^1$ is selected from a chemical bond, $C_1$ to $C_4$ alkandiyl, and phenylene.

In a preferred embodiment $R^{11}$ is selected from H and $C_1$ to $C_4$ alkyl, preferably H or methyl, most preferably H.

In the first embodiment, in formula L1A is a co-monomeric unit derived from vinyl alcohol, which may optionally be (poly)ethyoxylated, or acrylamide, and B is a monomeric unit of formula L1a (L1a)

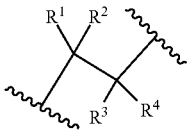

Generally, in formulas L1a and L2 of the first and the second embodiment, $R^2$, $R^3$ and $R^4$ are independently selected from $R^1$ and a group $R^R$ with $R^R$ being selected from (i) H, (ii) aryl, preferably a $C_6$ to $C_{10}$ carbocyclic aryl or a $C_3$ to $C_8$ heterocyclic aryl comprising up to two N atoms, most preferably phenyl or pyridyl, (iii) $C_1$ to $C_{10}$ alkyl, preferably $C_1$ to $C_6$ alkyl, more preferably $C_1$ to $C_4$ alkyl, most preferably $C_1$ to $C_3$ alkyl, (iv) arylalkyl, preferably a $C_7$ to $C_{15}$ carbocyclic arylalkyl or a $C_4$ to $C_8$ heterocyclic arylalkyl comprising up to two N atoms, more preferably $C_4$ to $C_8$ arylalkyl, most preferably benzyl or 1, 2, or 3-methylpyridine, (v) alkylaryl, preferably a $C_7$ to $C_{15}$ carbocyclic alkylaryl or a $C_4$ to $C_8$ heterocyclic alkylaryl comprising up to two N atoms, more preferably $C_4$ to $C_8$ alkylaryl, most preferably toluyl (otho, meta or para form) and 1, 2, or 3-methylpyridine, or (vi) a (poly)alkylene oxide substituent —(O—$C_2H_3R^{12}$)$_m$—OH, with m being an integer from 1 to 50, preferably 1 to 30, more preferably 1 or 2 to 20, most preferably 1 or 2 to 10, and $R^{12}$ being selected from H and $C_1$ to $C^4$ alkyl.

Since only one of $R^2$, $R^3$ and $R^4$ may comprise a group $R^1$ it is required that if one of $R^2$, $R^3$ or $R^4$ are selected from $R^1$, the other groups $R^2$, $R^3$ or $R^4$ are different from $R^1$.

In a particular embodiment, in formulas L1a and L2 of the first and the second embodiment, $R^2$ is selected from (i) H, (ii) aryl, preferably a $C_6$ to $C_{10}$ carbocyclic aryl or a $C_3$ to $C_8$ heterocyclic aryl comprising up to two N atoms, most preferably phenyl or pyridyl, (iii) $C_1$ to $C_{10}$ alkyl, preferably $C_1$ to $C_6$ alkyl, more preferably $C_1$ to $C_4$ alkyl, most preferably $C_1$ to $C_3$ alkyl, (iv) arylalkyl, preferably a $C_7$ to $C_{15}$ carbocyclic arylalkyl or a $C_4$ to $C_8$ heterocyclic arylalkyl comprising up to two N atoms, more preferably $C_4$ to $C_8$ arylalkyl, most preferably benzyl or 1, 2, or 3-methylpyridine, (v) alkylaryl, preferably a $C_7$ to $C_{15}$ carbocyclic alkylaryl or a $C_4$ to $C_8$ heterocyclic alkylaryl comprising up to two N atoms, more preferably $C_4$ to $C_8$ alkylaryl, most preferably toluyl (otho, meta or para form) and 1, 2, or 3-methylpyridine, or (vi) a (poly)alkylene oxide substituent —(O—$C_2H_3R^{12}$)$_m$—OH, with m being an integer from 1 to 50, preferably 1 to 30, more preferably 1 or 2 to 20, most preferably 1 or 2 to 10, and $R^{12}$ being selected from H and $C^1$ to $C^4$ alkyl.

In a particular embodiment, in formulas L1a and L2, $R^3$ is selected from $R^1$ and $R^R$. $R^4$ is selected from $R^R$ and, only in case $R^3$ is not $R^1$, $R^4$ may also be $R^1$. In other words: The formulas L1a and L2 may comprise one or two functional groups $R^1$. As a consequence, the levelers of L2 with two functional groups may have cis and trans configuration with respect to functional group $R^1$.

In another particular embodiment, $R^2$ is selected from $R^1$ and $R^3$ and $R^4$ are selected from $R^R$.

In a preferred embodiment, $R^2$, $R^3$ and $R^4$ are selected from H, methyl, ethyl, or propyl, most preferably H. In another preferred embodiment, $R^2$ and either $R^3$ or $R^4$ are selected from H, methyl, ethyl, or propyl, most preferably H and the other group $R^3$ or $R^4$ is selected from $R^1$. In another preferred embodiment, $R^2$ is selected from $R^1$ and $R^3$ and $R^4$ are selected from H, methyl, ethyl, or propyl, most preferably H.

In formula L1, n is an integer from 2 to 10,000 and p may either be 0 or an integer from 1 to 10,000.

If p is 0, the levelers of formula L1 may be homopolymers, such as but not limited to polyacrylic acid, polysulfonic acid, polyphosphonic acid and the like, in which $R^2$=$R^3$=$R^4$=H, or polymaleic acid, in which $R^2$=$R^4$=H and $R^3$=$R^1$ or $R^2$=$R^3$=H and $R^4$=$R^1$, or polyitaconic acid, in which $R^3$=$R^4$=H and $R^2$=$R^1$. Alternatively, the levelers of formula L1 may be co-polymers, such as but not limited to poly(acrylic acid-co-maleic acid), poly(acrylic acid-co-itaconic acid), poly(acrylic acid-co-2-methylacrylic acid), poly(sulfonic acid-co-maleic acid), poly(sulfonic acid-co-itaconic acid), poly(phosphonic acid-co-maleic acid), poly(phosphonic acid-co-itaconic acid), poly(phosphonic acid-co-sulfonic acid), and the like, in order to tune the sort and the amount of functional groups present in the leveler.

Alternatively, if p>0, the polymeric levelers may be co-polymers of the monomers mentioned above with further monomers like vinyl alcohol and its ethoxylated or polyethoxylated derivatives or acrylamide. In this case the sum of n and p is the overall degree of polymerization.

The degree of polymerization n+p in formula L1 is preferably an integer from 2 to 10,000. Most preferably n+p is an integer from 10 to 5000, most preferably from 20 to 5000.

If copolymers are used, such copolymers may have block, random, alternating or gradient, preferably random structure. As used herein, "random" means that the respective co-monomers are polymerized from a mixture and therefore arranged in a statistically manner depending on their copolymerization parameters. As used herein, "block" means that the respective co-monomers are polymerized after each other to form blocks of the respective co-monomers in any predefined order.

The molecular weight $M_w$ of the polymeric levelers of formula L1 may be from about 500 to about 500000 g/mol, preferably from about 1000 to about 350000 g/mol, most preferably from about 2000 to about 300000 g/mol. In one particular embodiment the molecular weight $M_w$ is from about 1500 to about 10000 g/mol. In another embodiment the molecular weight $M_w$ is from about 15000 to about 50000 g/mol. In yet another embodiment the molecular weight Mw is from about 100000 to about 300000 g/mol.

If copolymers are used, the ratio between two monomers B or the comonomers A and the monomers B in the levelers of formula L1 may be from 5:95 to 95:5% by weight, preferably from 10:90 to 90:10% by weight, most preferably from 20:80 to 80:40% by weight. Also terpolymers comprising two monomers B and a comonomer A may be used.

Particularly preferred polymeric levelers of formula L1 are polyacrylic acid, polyitaconic acid, a maleic acid acrylic acid copolymer, an itaconic acid acrylic acid copolymer, an acrylic acid 2-methylacrylic acid copolymer, polyphosphonic acid, and polysulfonic acid. Most preferred are polyacrylic acid, a maleic acid acrylic acid copolymer and an acrylic acid 2-methylacrylic acid copolymer. In case of a maleic acid acrylic acid copolymer or an itaconic acid acrylic acid copolymer a ratio p:n of 20 80 to 60:40% by weight is particularly preferred. In case of a 2-methylacrylic acid acrylic acid copolymer a ratio p:n of 20 80 to 80:20% by weight is particularly preferred.

The following specific copolymer levelers of formulas L1b to L1d are particularly preferred:

(L1b)

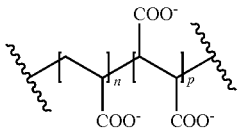

(L1c)

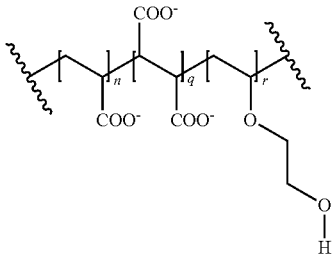

which is a terpolymer of acrylic acid, maleic acid and ethyoxylated vinyl alcohol, wherein q and r are integers, the sum q+r corresponds to p in formula 1 and the ratio q/r is from 10:90 to 90:10, preferably 20:80 to 80:40, most preferably from 40:60 to 60:40; and (L1d)

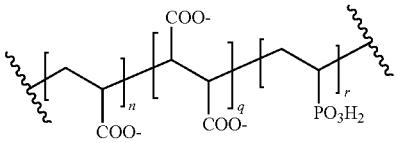

which is a terpolymer of acrylic acid, maleic acid and vinylphosphonic acid, wherein q and r are integers, the sum q+r corresponds to p in formula 1 and the ratio q/r is from 10:90 to 90:10, preferably 20:80 to 80:40, most preferably from 40:60 to 60:40.

Particularly preferred monomeric levelers of formula L2 are acrylic acid, vinylphosphonic acid, and vinylsulfonic acid.

In the third embodiment comprising a polymeric leveling agent of formula L3a or L3b (together also referred to as L3) $R^{31}$ may generally be $R^1$, H, $OR^{32}$ and $R^{32}$ as defined above. Preferably, $R^{31}$ is H or OH. Such polymers are available in the market under Napthalene sulphonic acid condensation product, Na-salt and Phenol sulfonic acid condensation product, Na-salt, e.g. from BASF.

In the levelers of formula L3 $X^2$ is (i) a chemical bond or (ii) methanediyl. Preferably $X^2$ is methanediyl.

The degree of polymerization o in the levelers of formula L3 is from 2 to 1000. Preferably o is an integer from 5 to 500, most preferably from 10 to 250.

The molecular weight $M_w$ of the polymeric levelers L3 may be from about 500 to about 400000 g/mol, preferably from about 1000 to about 300000 g/mol, most preferably from about 3000 to about 250000 g/mol. In one particular embodiment the molecular weight $M_w$ is from about 1500 to about 10000 g/mol. In another embodiment the molecular weight $M_w$ is from about 15000 to about 50000 g/mol. In yet another embodiment the molecular weight Mw is from about 100000 to about 300000 g/mol.

In the fourth embodiment, the levelers of formula, L4 Ø is a $C_6$ to $C_{14}$ carbocyclic or a $C_3$ to $C_{10}$ nitrogen or oxygen containing heterocyclic aryl group, which may be unsubstituted or substituted by up to three $C_1$ to $C_{12}$ alkyl groups or up to two OH, $NH_2$ or $NO_2$ groups. Preferably the heterocyclic aryl groups are 5 or 6 membered rings systems with up to 2, preferably 1, N atoms.

Preferred groups Ø are those of formula L4a (L4a)

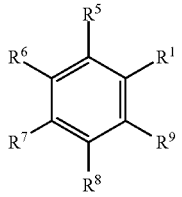

wherein $R^5$, $R^6$, $R^7$, $R^8$, and $R^9$ are independently selected from (i) H and (ii) $C_1$ to $C_6$ alkyl. Preferably $R^5$, $R^6$, $R^8$, and $R^9$ are independently selected from H, methyl, ethyl or propyl, most preferably H. Preferably $R^7$ is selected from H, methyl, ethyl or propyl, most preferably from methyl or ethyl.

In certain embodiments, the leveler may be present in a concentration between about 1-10,000 ppm, or between about 10-1,000 ppm, or between about 10-500 ppm. In some cases, the concentration of leveler may be at least about 1 ppm, or at least about 100 ppm. In these or other cases, the concentration of leveler may be about 500 ppm or less, or about 1000 ppm or less.

In one embodiment a single leveling agent may be used in the cobalt electroplating baths, i.e. the bath is essentially free from any further leveling agent as described in the section below. In another embodiment two or more of the leveling agents are used in combination.

Other Leveling Agents

The plating composition may further comprise one or more additional leveling agents.

Other levelers often contain one or more nitrogen, amine, imide or imidazole, and may also contain sulfur functional groups. Certain levelers include one or more five and six member rings and/or conjugated organic compound derivatives. Nitrogen groups may form part of the ring structure. In amine-containing levelers, the amines may be primary, secondary or tertiary alkyl amines. Furthermore, the amine may be an aryl amine or a heterocyclic saturated or aromatic amine. Example amines include, but are not limited to, dialkylamines, trialkylamines, arylalkylamines, triazoles, imidazole, triazole, tetrazole, benzimidazole, benzotriazole, piperidine, morpholines, piperazine, pyridine, oxazole, benzoxazole, pyrimidine, quonoline, and isoquinoline. Imidazole and pyridine may be useful in some cases. Other examples of levelers include Janus Green B and Prussian Blue. Leveler compounds may also include ethoxide groups. For example, the leveler may include a general backbone similar to that found in polyethylene glycol or polyethylene oxide, with fragments of amine functionally inserted over the chain (e.g., Janus Green B). Example epoxides include, but are not limited to, epihalohydrins such as epichlorohydrin and epibromohydrin, and polyepoxide compounds. Polyepoxide compounds having two or more epoxide moieties joined together by an ether-containing linkage may be useful in some cases. Some leveler compounds are polymeric, while others are not. Example polymeric leveler compounds include, but are not limited to, polyethyleneimine, polyamidoamines, and reaction products of an amine with various oxygen epoxides or sulfides. One example of a non-polymeric leveler is 6-mercapto-hexanol. Another example leveler is polyvinylpyrrolidone (PVP).

Example levelers that may be particularly useful in the context of cobalt deposition in combination with the leveler according to the subject invention include, but are not limited to: alkylated polyalkyleneimines; polyethylene glycol; organic sulfonates; 4-mercaptopyridine; 2-mercaptothiazoline; ethylene thiourea; thiourea; 1-(2-hydroxyethyl)-2-imidazolidinethion; sodium naphthalene 2-sulphonate; acrylamide; substituted amines; imidazole; triazole; tetrazole; piperidine; morpholine; piperazine; pyridine; oxazole; benzoxazole; quinolin; isoquinoline; coumarin and derivatives thereof.

Suppressing Agents

The plating composition may further comprise, and preferably comprises, one or more suppressing agents. Particularly if the semiconductor substrate to be electroplated comprises recessed features having an aperture size below 100 nm, particularly below 50 nm, even more particular if the aspect ratio of the recessed features is 4 or more, the use of a suppressing agent is usually required.

As used herein, "suppressing agent" refers to an organic compound that decreases the plating rate of the electroplating bath on at least part of a substrate. In particular, a suppressor is an additive that suppresses the plating rate on the substrate above any recessed features. Dependent on the diffusion and adsorption the suppressor decreases the plating rate at the upper sidewalls of the recessed features. The terms "suppressor" and "suppressing agent" are used interchangeably throughout this specification.

As used herein, "feature" refers to the cavities on a substrate, such as, but not limited to, trenches and vias. "Apertures" refer to recessed features, such as vias and trenches. As used herein, the term "plating" refers to metal electroplating, unless the context clearly indicates otherwise. "Deposition" and "plating" are used interchangeably throughout this specification.

"Aperture size" according to the present invention means the smallest diameter or free distance of a recessed feature before plating, i.e. after seed deposition. The terms "width", "diameter", "aperture" and "opening" are used herein, depending on the geometry of the feature (trench, via, etc.) synonymously.

As used herein, "aspect ratio" means the ratio of the depth to the aperture size of the recessed feature.

Without limitation, typical suppressing agents are selected from the group consisting of: carboxymethylcellulose, nonylphenolpolyglycol ether, polyethylene glycoldimethyl ether, octandiolbis(polyalkylene glycol ether), octanol polyalkylene glycol ether, oleic acid polyglycol ester, polyethylene propylene glycol, polyethylene glycol, polyethyleneimine, polyethylene glycoldimethyl ether, polyoxypropylene glycol, polypropylene glycol, polyvinyl alcohol, stearic acid polyglycol ester, stearyl alcohol polyglycol ether, polyethylene oxide, ethylene oxide-propylene oxide copolymers, butyl alcohol-ethylene oxide-propylene oxide copolymers, 2-Mercapto-5-benzimidazolesulfonic acid, 2-mercaptobenzimidazole (MBI), benzotriazole, and combinations thereof.

In some embodiments, the suppressor includes one or more nitrogen atoms such as an amine group or an imine group. In some embodiments, the suppressor is a polymeric or oligomeric compound containing amine groups separated by a carbon aliphatic spacer such as $CH_2CH_2$ or $CH_2CH_2CH_2$. In a particular embodiment, the suppressor is polyethyleneimine (PEI, also known as polyaziridine, poly [imino(1,2-ethanediyl)], or poly(iminoethylene)). PEI has shown very good bottom-up fill characteristics in the context of cobalt deposition, as shown in the experimental results included herein.

Particularly preferred suppressing agents are those of formula S1

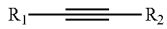

(S1)

to fill aperture sizes having nanometer or micrometer scale, in particular aperture sizes having 100 nanometers or less, 20 nm or less, 15 nm or less or even 7 nm or less.

Herein, $R^1$ is selected from X-Y, wherein X is a divalent spacer group selected from linear or branched $C_1$ to $C_{10}$ alkanediyl, linear or branched $C_2$ to $C_{10}$ alkenediyl, linear or branched $C_2$ to $C_{10}$ alkynediyl, and $(C_2H_3R^6—O)_m$. m is an integer selected from 1 to 30, preferably from 1 to 15, even more preferably from 1 to 10, most preferably from 1 to 5.

In a preferred embodiment X is selected from linear or branched $C_1$ to $C_6$ alkanediyl, preferably from $C_1$ to $C_4$ alkanediyl.

In a preferred embodiment X is selected from methanediyl, ethane-1,1-diyl and ethane-1,2-diyl. In a second preferred embodiment X is selected from propan-1,1-diyl, butane-1,1-diyl, pentane-1,1-diyl, and hexane-1,1-diyl. In a third preferred embodiment X is selected from propane-2-2-diyl, butane-2,2-diyl, pentane-2,2-diyl, and hexane-2,2-diyl. In a fourth preferred embodiment X is selected from propane-1-2-diyl, butane-1,2-diyl, pentane-1,2-diyl, and hexane-1,2-diyl. In a fifth preferred embodiment X is selected from propane-1-3-diyl, butane-1,3-diyl, pentane-1,3-diyl, and hexane-1,3-diyl.

Y is a monovalent group and may be selected from $OR^3$, with $R^3$ being selected from (i) H, (ii) $C_5$ to $C_{20}$ aryl, preferably $C_5$, $C_6$, and $C_{10}$ aryl, (iii) $C_1$ to $C_{10}$ alkyl, preferably $C_1$ to $C_6$ alkyl, most preferably $C_1$ to $C_4$ alkyl, (iv) $C_6$ to $C_{20}$ arylalkyl, preferably $C_6$ to $C_{10}$ arylalkyl, (v) $C_6$ to $C_{20}$ alkylaryl, all of which may be substituted by OH, $SO_3H$, COOH or a combination thereof, and (vi) $(C_2H_3R^6—O)_n—H$. In a preferred embodiment, $R^3$ may be $C_1$ to $C_6$ alkyl or H. $R^6$ may be selected from H and $C_1$ to $C_5$ alkyl, preferably from H and $C_1$ to $C_4$ alkyl, most preferably H, methyl or ethyl.

In another preferred embodiment, $R^3$ is selected from H to form a hydroxy group. In another preferred embodiment, $R^3$ is selected from polyoxyalkylene groups of formula $(C_2H_3R^6—O)_n—H$. $R^6$ is selected from H and $C_1$ to $C_5$ alkyl, preferably from H and $C_1$ to $C_4$ alkyl, most preferably from H, methyl or ethyl. Generally, n may be an integer from 1 to 30, preferably from 1 to 15, most preferably from 1 to 10. In a particular embodiment polyoxymethylene, polyoxypropylene or a polyoxymethylene-co-oxypropylene may be used. In another preferred embodiment, $R^3$ may be selected from $C_1$ to $C_{10}$ alkyl, preferably from $C_1$ to $C_6$ alkyl, most preferably methyl and ethyl.

Furthermore, Y may be an amine group $NR^3R^4$, wherein $R^3$ and $R^4$ are the same or different and may have the meanings of $R^3$ described for $OR^3$ above.

In a preferred embodiment, $R^3$ and $R^4$ are selected from H to form an $NH_2$ group. In another preferred embodiment, at least one of $R^3$ and $R^4$, preferably both are selected from polyoxyalkylene groups of formula $(C_2H_3R^6—O)_n—H$. $R^6$ is selected from H and $C_1$ to $C_5$ alkyl, preferably from H and $C_1$ to $C_4$ alkyl, most preferably H, methyl or ethyl. In yet another preferred embodiment, at least one of $R^3$ and $R^4$, preferably both are selected from $C_1$ to $C_{10}$ alkyl, preferably from $C_1$ to $C_6$ alkyl, most preferably methyl and ethyl.

$R^3$ and $R^4$ may also together form a ring system, which may be interrupted by O or $NR^7$. $R^7$ may be selected from $R^6$ and $X{\equiv}R_3$. Such ring system may preferably comprise 4 or 5 carbon atoms to form a 5 or 6 membered carbocyclic system. In such carbocyclic system one or two of the carbon atoms may be substituted by oxygen atoms.

Furthermore, Y may be a positively charged ammonium group $N^+R^3R^4R^5$. $R^3$, $R^4$, $R^5$ are the same or different and may have the meanings of $R^3$ described for $OR^3$ and $NR^3R^4$ above. In a preferred embodiment $R^3$, $R^4$ and $R^5$ are independently selected from H, methyl or ethyl.

m may be an integer selected from 1 to 30, preferably from 1 to 15, even more preferably from 1 to 10, most preferably from 1 to 5.

In the additives of formula S1 $R^2$ may be either selected from $R^1$ or $R^3$ as described above. If $R^2$ is $R^1$, $R^1$ may be selected to form a symmetric compound (both $R^1$s are the same) or an asymmetric compound (the two $R^1$s are different).

In a preferred embodiment $R^2$ is H.

Particularly preferred aminoalkynes are those in which (a) $R^1$ is $X—NR^3R^4$ and $R^2$ is H;

(b) $R^1$ is $X—NR^3R^4$ and $R^2$ is $X—NR^3R^4$ with X being selected from linear $C_1$ to $C_4$ alkanediyl and branched $C_3$ to $C_6$ alkanediyl;

Particularly preferred hydroxyalkynes or alkoxyalkynes are those in which (a) $R^1$ is $X—OR^3$ and $R^2$ is H;

(b) $R^1$ is $X—OR^3$ and $R^2$ is $X—OR^3$ with X being selected from linear $C_1$ to $C_4$ alkanediyl and branched $C_3$ to $C_6$ alkanediyl;

Particularly preferred alkynes comprising an amino and a hydroxy group are those in which $R^1$ is $X—OR^3$, particularly X—OH, and $R^2$ is $X—NR^3R^4$ with X being independently selected from linear $C_1$ to $C_4$ alkanediyl and branched $C_3$ to $C_6$ alkanediyl;

The amine groups in the additives may be selected from primary ($R^3$, $R^4$ is H), secondary ($R^3$ or $R^4$ is H) and tertiary amine groups ($R^3$ and $R^4$ are both not H).

The alkynes may comprise one or more terminal triple bonds or one or more non-terminal triple bonds (alkyne functionalities). Preferably, the alkynes comprise one or more terminal triple bonds, particularly from 1 to 3 triple bonds, most preferably one terminal triple bond.

Particularly preferred specific primary aminoalkynes are:

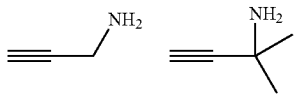

Particularly preferred specific secondary aminoalkynes are:

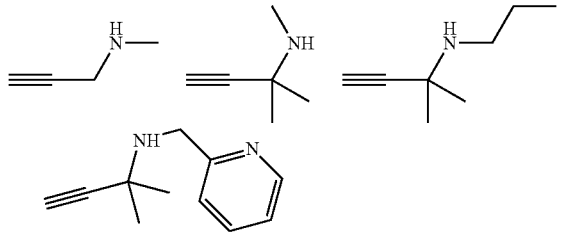

Particularly preferred specific tertiary aminoalkynes are:

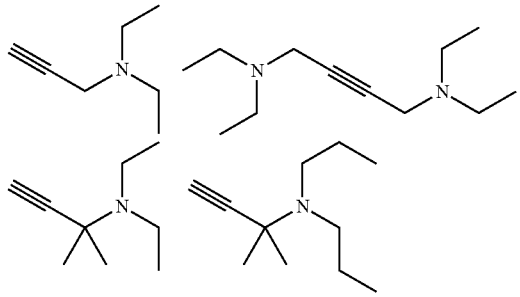

Other preferred additives are those in which the rests $R^3$ and $R^4$ may together form a ring system, which is optionally interrupted by O or $NR^3$. Preferably, the rests $R^3$ and $R^4$ together form a $C_5$ or $C_6$ bivalent group in which one or two, preferably one, carbon atoms may be exchanged by O or $NR^7$, with $R^7$ being selected from hydrogen, methyl or ethyl.

An example of such compounds is:

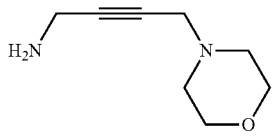

The first one may be received by reaction of propargyl amine with formaldehyde and morpholine, the second and third ones by reaction of propargyl alcohol with formaldehyde and piperidine or morpholine, respectively.

Another preferred additive comprising a saturated heterocyclic system is:

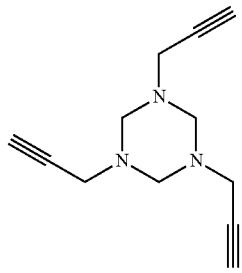

In this case $R^3$ and $R^4$ together form a ring system which is interrupted by two $NR^3$ groups, in which $R^3$ is selected from $CH_2$—C≡C—H. This additive comprises three terminal triple bonds.

The amino groups in the additives may further be quaternized by reaction with alkylating agents such as but not limited to dialkyl sulphates like DMS, DES or DPS, benzyl chloride or chlormethylpyridine. Particularly preferred quaternized additives are:

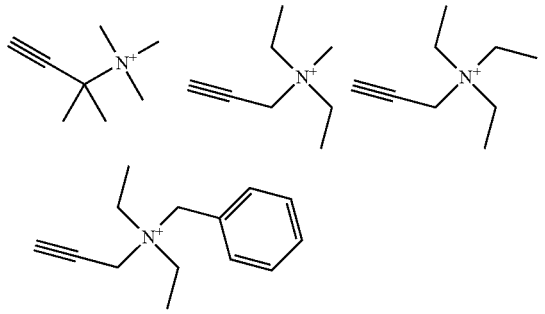

Particularly preferred specific pure hydroxyalkynes are:

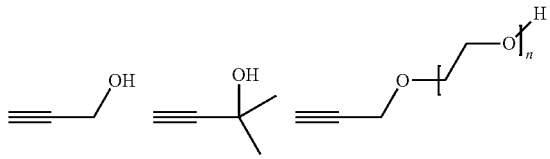

Particularly preferred specific aminoalkynes comprising OH groups are:

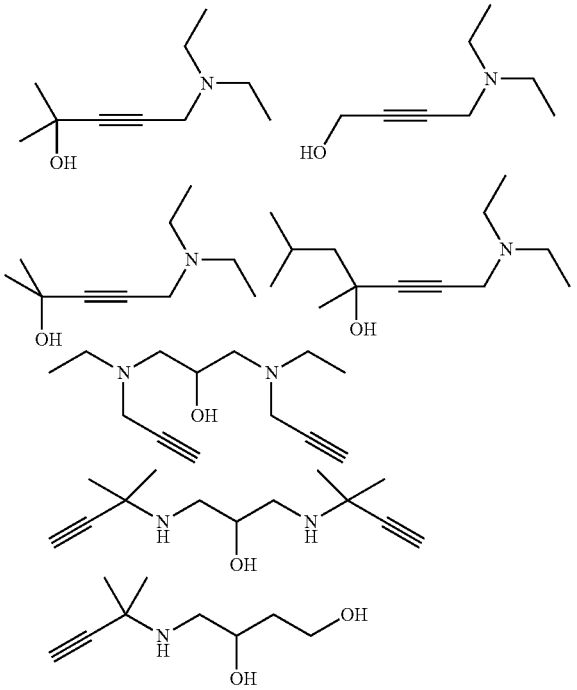

-continued

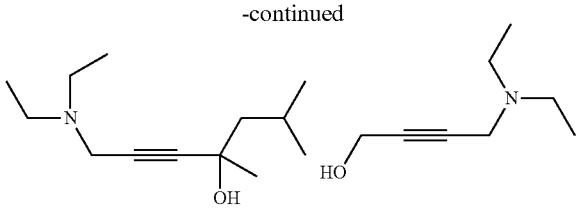

Also in this case the rests $R^3$ and $R^4$ may together form a ring system, which is optionally interrupted by O or $NR^3$. Preferably, the rests $R^3$ and $R^4$ together form a $C_5$ or $C_6$ bivalent group in which one or two, preferably one, carbon atoms may be exchanged by O or $NR^7$, with $R^7$ being selected from hydrogen, methyl or ethyl.

Examples for such compounds are:

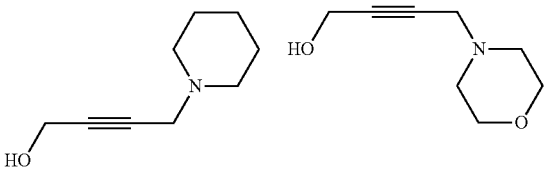

These may be received by reaction of propargyl alcohol with formaldehyde and piperidine or morpholine, respectively.

By partial reaction with alkylating agents mixtures of additives may be formed. In one embodiment, such mixtures may be received by reaction of 1 mole diethylaminopropyne and 0.5 mole epichlorohydrin, 1 mole diethylaminopropyne and 0.5 mole benzylchloride, 1 mole diethylaminopropyne with 0.9 mole dimethyl sulphate, 1 mole dimethyl propyne amine and 0.33 mole dimethyl sulphate, or 1 mole dimethyl propyne amine and 0.66 mole dimethyl sulphate. In another embodiment such mixtures may be received by reaction of 1 mole dimethyl propyne amine and 1.5, 1.9, or 2.85 mole dimethyl sulphate, 1 mole dimethyl propyne amine and 0.5 mole epichlorohydrin, 1 mole dimethyl propyne amine and 2.85 diethyl sulphate, or 1 mole dimethyl propyne amine and 1.9 mole dipropyl sulphate.

In a further embodiment, the suppressing agents may be substituted by $SO_3H$ (sulfonate) groups or COOH (carboxy) groups. Specific sulfonated additives may be but are not limited to butynoxy ethane sulfonic acid, propynoxy ethane sulfonic acid, 1,4-di-(β-sulfoethoxy)-2-butyne, 3-(β-sulfoethoxy)-propyne.

In general, the total amount of the suppressing agents in the electroplating bath is from 0.5 ppm to 10000 ppm based on the total weight of the plating bath. The suppressing agents are typically used in a total amount of from about 0.1 ppm to about 1000 ppm based on the total weight of the plating bath and more typically from 1 to 100 ppm, although greater or lesser amounts may be used. Preferred concentration ranges are for example between about 10-60 ppm, or between about 15-60 ppm, or between about 30-60 ppm. In this context, parts per million (ppm) is a mass fraction of the suppressor molecules in the electrolyte. In some cases, the suppressor may have a concentration of at least about 10 ppm, or at least about 15 ppm, or at least about 20 ppm, or at least about 30 ppm, or at least about 50 ppm. In these or other cases, the suppressor may have a concentration of about 1,000 ppm or less, for example about 500 ppm or less, about 100 ppm or less, about 75 ppm or less, about 60 ppm or less, or about 50 ppm or less.

Other Additives

A large variety of further additives may typically be used in the bath to provide desired surface finishes for the Co plated metal. Usually more than one additive is used with each additive forming a desired function. Advantageously, the electroplating baths may contain one or more of wetting agents or surfactants like Lutensol®, Plurafac® or Pluronic® (available from BASF) to get rid of trapped air or hydrogen bubbles and the like. Further components to be added are grain refiners, stress reducers, levelers and mixtures thereof.

The bath may also contain a complexing agent for the cobalt ions, such as but not limited to sodium acetate, sodium citrate, EDTA, sodium tartrate, or ethylene diamine.

Further additives are disclosed in Journal of The Electrochemical Society, 156 (8) D301-D309 2009 "Superconformal Electrodeposition of Co and Co—Fe Alloys Using 2-Mercapto-5-benzimidazolesulfonic Acid", which is incorporated herein by reference.

In a further embodiment, surfactants may be present in the electroplating composition in order to improve wetting. Wetting agents may be selected from nonionic surfactants, anionic surfactants and cationic surfactants.

In a preferred embodiment non-ionic surfactants are used. Typical non-ionic surfactants are fluorinated surfactants, polyglocols, or poly oxyethylene and/or oxypropylene containing molecules.

Electrolyte

In one embodiment, the usually aqueous plating bath used for void-free filling with cobalt may contain a cobalt ion source, such as but not limited to cobalt sulfate, cobalt chloride, or cobalt sulfamate. Preferably the metal ions essentially consist of cobalt ions. As used herein, "consisting essentially of cobalt ions" means a content of other metal ions less than 1% by weight, preferably less than 0.1% by weight, more preferably less than 0.01% by weight. Most preferably the electrodeposition composition is free of any metal ions except cobalt ions.

The cobalt ion concentration within the electroplating solution may be in a range of 0.01 to 1 mol/l. In one particular example, the ion concentration can have a range of 0.1 to 0.6 mol/l. In another particular example, the range can be from 0.3 to 0.5 mol/l. In yet another particular example, the range can be from 0.03 to 0.1 mol/l.

In a preferred embodiment the composition is essentially free of chloride ions. Essentially free from chloride means that the chloride content is below 1 ppm, particularly below 0.1 ppm.

During deposition, the pH of the plating bath may be adjusted to have a high Faradaic efficiency while avoiding the co-deposition of cobalt hydroxides. For this purpose, a pH range of 1 to 5 may be employed. In a particular example pH range of 2 to 4.5 can be employed. In another particular example, a pH range of 3 to 4 can be used. Preferably the pH is below 5, most preferably below 4.

In a preferred embodiment boric acid may be used in the cobalt electroplating bath as supporting electrolyte. Boric acid may be incorporated into the composition in a concentration between about 5 and about 50 g/l, such as between about 15 and about 40 g/l.

In another preferred embodiment the cobalt electrodeposition composition comprises an ammonium compound. The ammonium compound is added to the electrolyte in form of different types of ammonium compounds like ammonium sulfate, ammonium chloride, ammonium methane sulfonate as described in unpublished European patent application No. 18168249.3.

Generally the ammonium compound is described by formula $(NR^{B1}R^{B2}R^{B3}H^{+})_{n}X^{n-}$.

Herein, $R^{B1}$, $R^{B2}$, and $R^{B3}$ are independently selected from H, linear or branched $C_1$ to $C_6$ alkyl. Preferably, $R^1$, $R^2$, and $R^3$ are independently selected from H and a linear or branched $C_1$ to $C_4$ alkyl, particularly methyl and ethyl. More preferably at least one of $R^{B1}$, $R^{B2}$, and $R^{B3}$ is H, even more preferably at least two of $R^{B1}$, $R^{B2}$, and $R^{B3}$ are H. Most preferably, $R^{B1}$, $R^{B2}$, and $R^{B3}$ are H.

X is an n valent inorganic or organic counter ion. Typical inorganic counter-ions are, without limitation, chloride, sulfate (including hydrogen sulfate), phosphate (including hydrogen and dihydrogen phosphate), and nitrate. Typical organic counter-ions are, without limitation, $C_1$ to $C_6$ alkyl sulfonate, preferably methane sulfonate, $C_1$ to $C_6$ carboxylates, preferably acetate or citrate, phosphonate, sulfamate, etc. Inorganic counter-ions are preferred. Chloride is the most preferred counter ions X since by using chloride in combination with the ammonium cation the non-uniformity of the cobalt deposit across the wafer may be further improved.

n is an integer selected from 1, 2 or 3 depending on the valence of the counter-ion. By way of example, for chloride and hydrogen sulfate n would be 1, for sulfate or hydrogen phosphate n would be 2 and for phosphate n would be 3.

Depending on the pH of the composition the amine compound may be completely or partly protonated or deprotonated.

Preferably the cobalt or electroplating composition is essentially free of boric acid. Essentially free of boric acid as used herein means a boric acid content below 0.1 g/l, preferably below 100 ppm by mass, most preferably the content of boric acid is below the detection limit.

The electrodeposition composition is preferably free of zinc ions, nickel ions and iron ions. If either nickel ions or iron ions are present, the molar ratio of both nickel ions and iron ions, and the sum of zinc ions, nickel ions and iron ions, to cobalt ions is preferably not greater than about 0.01, or between about 0.00001 and about 0.01.

The electrodeposition composition is also preferably substantially free of copper ions. Although very minor copper contamination may be difficult to avoid, it is particularly preferred that the copper ion content of the bath is no more than 20 ppb, e.g., in the range of 0.1 ppb to 20 ppb.

The electrodeposition composition is preferably free of any functional concentration of reducing agents effective to reduce cobaltous ion ($Co^{2+}$) to metallic cobalt ($Co^{0}$). By a functional concentration is meant any concentration of an agent that either is effective to reduce cobaltous ions in the absence of electrolytic current or is activated by an electrolytic current or electrolytic field to react with cobaltous ions.

The electrodeposition composition is essentially free of dispersed particles, preferably free of particles. "Essentially free of dispersed particles" means that there are no macroscopic particulate solids in the solution that are dispersed and therefore negatively interfere with the metal electroplating process. Any particles that are deposited and not dispersed during storage of the bath or during the electroplating process do usually not interfere with the metal electroplating.

The electrodeposition composition is preferably a homogeneous composition. As used herein, "homogeneous" means that the composition is a solution of the components in a liquid that is essentially free of any particles, particularly free of any dispersed particles.

Process

An electrolytic bath is prepared comprising cobalt ions and at least one additive according to the invention. A dielectric substrate having the seed layer is placed into the electrolytic bath where the electrolytic bath contacts the at least one outer surface and the three dimensional pattern having a seed layer in the case of a dielectric substrate. A counter electrode is placed into the electrolytic bath and an electrical current is passed through the electrolytic bath between the seed layer on the substrate and the counter electrode. At least a portion of cobalt is deposited into at least a portion of the three dimensional pattern wherein the deposited cobalt is substantially void-free.

The present invention is useful for depositing a layer comprising cobalt on a variety of substrates, particularly those having nanometer and variously sized apertures. For example, the present invention is particularly suitable for depositing cobalt on integrated circuit substrates, such as semiconductor devices, with small diameter vias, trenches or other apertures. In one embodiment, semiconductor devices are plated according to the present invention. Such semiconductor devices include, but are not limited to, wafers used in the manufacture of integrated circuits.

In order to allow a deposition on a substrate comprising a dielectric surface a seed layer needs to be applied to the surface. Such seed layer may consist of cobalt, iridium, osmium, palladium, platinum, rhodium, and ruthenium or alloys comprising such metals. Preferred is the deposition on a cobalt seed. The seed layers are described in detail e.g. in US20140183738 A.

The seed layer may be deposited or grown by chemical vapor deposition (CVD), atomic layer deposition (ALD), physical vapor deposition (PVD). Electroplating, electro less plating or other suitable process that deposits conformal thin films. In an embodiment, the cobalt seed layer is deposited to form a high quality conformal layer that sufficiently and evenly covers all exposed surfaces within the openings and top Surfaces. The high quality seed layer may be formed, in one embodiment, by depositing the cobalt seed material at a slow deposition rate to evenly and consistently deposit the conformal seed layer. By forming the seed layer in a conformal manner, compatibility of a subsequently formed fill material with the underlying structure may be improved. Specifically, the seed layer can assist a deposition process by providing appropriate surface energetics for deposition thereon.

Preferably the substrate comprises submicrometer sized features and the cobalt deposition is performed to fill the submicrometer sized features. Most preferably the submicrometer-sized features have an (effective) aperture size of 10 nm or below and/or an aspect ratio of 4 or more. More preferably the features have an aperture size of 7 nanometers or below, most preferably of 5 nanometers or below.

The electrodeposition current density should be chosen to promote the void-free, particularly the bottom-up filling behavior. A range of 0.1 to 40 mA/cm$^2$ is useful for this purpose. In a particular example, the current density can range from 1 to 10 mA/cm$^2$. In another particular example, the current density can range from 5 to 15 mA/cm$^2$.

The general requirements for a process of cobalt electrodeposition on semiconductor integrated circuit substrates is described in US 2011/0163449 A1.

Typically, substrates are electroplated by contacting the substrate with the plating baths of the present invention. The substrate typically functions as the cathode. The plating bath contains an anode, which may be soluble or insoluble. Optionally, cathode and anode may be separated by a membrane. Potential is typically applied to the cathode. Sufficient current density is applied and plating performed for a period of time sufficient to deposit a metal layer, such as a cobalt layer, having a desired thickness on the substrate. Suitable current densities include, but are not limited to, the range of 1 to 250 mA/cm$^2$. Typically, the current density is in the range of 1 to 60 mA/cm$^2$ when used to deposit cobalt in the manufacture of integrated circuits. The specific current density depends on the substrate to be plated, the leveling agent selected and the like. Such current density choice is within the abilities of those skilled in the art. The applied current may be a direct current (DC), a pulse current (PC), a pulse reverse current (PRC) or other suitable current.

In general, when the present invention is used to deposit metal on a substrate such as a wafer used in the manufacture of an integrated circuit, the plating baths are agitated during use. Any suitable agitation method may be used with the present invention and such methods are well-known in the art. Suitable agitation methods include, but are not limited to, inert gas or air sparging, work piece agitation, impingement and the like. Such methods are known to those skilled in the art. When the present invention is used to plate an integrated circuit substrate, such as a wafer, the wafer may be rotated such as from 1 to 300 RPM and the plating solution contacts the rotating wafer, such as by pumping or spraying. In the alternative, the wafer need not be rotated where the flow of the plating bath is sufficient to provide the desired metal deposit.

Cobalt is deposited in apertures according to the present invention without substantially forming voids within the metal deposit.

As used herein, void-free fill may either be ensured by an extraordinarily pronounced bottom-up cobalt growth while perfectly suppressing the sidewall cobalt growth, both leading to a flat growth front and thus providing substantially defect free trench/via fill (so-called bottom-up-fill) or may be ensured by a so-called V-shaped filling.

As used herein, the term "substantially void-free", means that at least 95% of the plated apertures are void-free. Preferably that at least 98% of the plated apertures are void-free, mostly preferably all plated apertures are void-free. As used herein, the term "substantially seam-free", means that at least 95% of the plated apertures are void-free. Preferably that at least 98% of the plated apertures are seam-free, mostly preferably all plated apertures are seam-free.

Plating equipment for plating semiconductor substrates are well known. Plating equipment comprises an electroplating tank which holds Co electrolyte and which is made of a suitable material such as plastic or other material inert to the electrolytic plating solution. The tank may be cylindrical, especially for wafer plating. A cathode is horizontally disposed at the upper part of tank and may be any type substrate such as a silicon wafer having openings such as trenches and vias. The wafer substrate is typically coated with a seed layer of Co or other metal or a metal containing layer to initiate plating thereon. An anode is also preferably circular for wafer plating and is horizontally disposed at the lower part of tank forming a space between the anode and cathode. The anode is typically a soluble anode.

These bath additives are useful in combination with membrane technology being developed by various tool manufacturers. In this system, the anode may be isolated from the organic bath additives by a membrane. The purpose of the separation of the anode and the organic bath additives is to minimize the oxidation of the organic bath additives.

The cathode substrate and anode are electrically connected by wiring and, respectively, to a rectifier (power supply). The cathode substrate for direct or pulse current has a net negative charge so that Co ions in the solution are reduced at the cathode substrate forming plated Co metal on the cathode surface. An oxidation reaction takes place at the anode. The cathode and anode may be horizontally or vertically disposed in the tank.

While the process of the present invention has been generally described with reference to semiconductor manufacture, it will be appreciated that the present invention may be useful in any electrolytic process where a substantially void-free cobalt deposit is desired. Such processes include printed wiring board manufacture. For example, the present plating baths may be useful for the plating of vias, pads or traces on a printed wiring board, as well as for bump plating on wafers. Other suitable processes include packaging and interconnect manufacture. Accordingly, suitable substrates include lead frames, interconnects, printed wiring boards, and the like.

All percent, ppm or comparable values refer to the weight with respect to the total weight of the respective composition except where otherwise indicated. All cited documents are incorporated herein by reference.

The following examples shall further illustrate the present invention without restricting the scope of this invention.

EXAMPLES

A. Example Levelers

Leveler 1: Copolymer of acrylic acid and maleic acid having a (mass average) molecular weight $M_w$ of 3,000 g/mol and an MA content of 50% by weight.

Leveler 2: Copolymer of acrylic acid and methylacrylic acid having a molecular weight $M_w$ of 20,000 g/mol and an MA content of 70% by weight.

Leveler 3: Polyacrylic acid having a molecular weight $M_w$ of 2,500 g/mol

Leveler 4: Polyacrylic acid having a molecular weight $M_w$ of 250,000 g/mol

Leveler 5: Sodium p-Toluol sulfonate

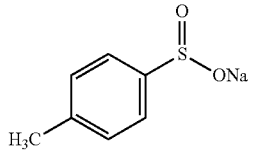

Leveler 6: Vinylphosphonic acid

Leveler 7: Polyvinylphosphonic acid having a molecular weight $M_w$ of 2,310 g/mol Leveler 8: Polyvinylsulfonic acid having a molecular weight $M_w$ of 250,000 g/mol.

These compounds are available in the market.

B. Plating Experiments

Example 1 (Comparative)

Plating was done using a potentiostat setup, immersing the wafer coupon pieces in an electrolyte bath opposite a blank Co anode. The electrolyte was an aqueous Co sulfate-based solution comprised of 3 g/L cobalt, 33 g/L boric acid, and water. The electrolyte was adjusted to a pH of 2.75 with 1 M $H_2SO_4$. An alkynole type suppressor at a concentration of 72 ppm was used. The electrolyte was maintained at 25° C. with a pH of 2.75. Patterned wafer coupons, each piece including trench features of various dimensions of 40 nm, 50 nm, 85 nm, and 120 nm (pitch: 1:1), were immersed in the electrolyte solution at −1V potentiostatic entry for 0.5 s before galvanostatic control was enabled. Galvanostatic plating then proceeded in a two-step process: Step 1 with an applied current density of 2 mA/cm$^2$ for 200 s wherein the wafer coupon cathode was rotated at 100 rpm, and Step 2 with an applied current density of 10 mA/cm$^2$ for 110 s wherein the wafer coupon was rotated at 25 rpm. The plating conditions were selected for optimal fill with a suppressor-only bath, and plating was done with baths incorporating both suppressor only and suppressor and leveler combined.

Measurements of bump height were completed by profilometry and measured against a reference point over an unpatterned wafer area. The results are summarized in Table 1 and depicted in Fig. 1. Fig. 1 shows a cobalt deposition which fails in the desired leveling. This can be clearly seen from the bump formation of more than 200 nm over the dense features.

Examples 2 to 9

Example 1 was repeated but the respective Leveler was added to the plating bath at a concentration specified in Table 1.

The results are summarized in Table 1. Table 1 shows that the cobalt deposition provides the desired leveling behavior. This can particularly be seen by a reduced bump formation particularly over the dense features of 40 and 50 nm width when adding the respective leveler.

TABLE 1

| Example | Leveler | L dose [ppm] | 40nm 1:1 pitch [nm] | 50nm 1:1 pitch [nm] | 85nm 1:1 pitch [nm] | 120nm 1:1 pitch [nm] |
|---|---|---|---|---|---|---|
| 1 | none | 0 | 237 | 231 | 185 | 208 |
| 2 | Leveler 1 | 0.9 | 113 | 123 | 101 | 57 |
| 3 | Leveler 2 | 9 | 58 | 119 | 117 | 83 |
| 4 | Leveler 3 | 0.9 | 24 | 22 | 39 | 5 |
| 5 | Leveler 4 | 0.9 | 45 | 54 | 38 | 24 |
| 6 | Leveler 5 | 0.09 | 119 | 121 | 150 | 114 |
| 7 | Leveler 6 | 85 | 102 | 63 | 46 | 129 |
| 8 | Leveler 7 | 9 | 93 | 104 | 90 | 59 |
| 9 | Leveler 8 | 450 | 104 | 40 | 44 | 22 |

The invention claimed is:

1. A composition for cobalt electroplating comprising:

(a) metal ions consisting essentially of cobalt ions, and (b) a leveling agent, wherein the composition excludes a functional concentration of reducing agents, wherein the pH is within the range of 1 to 5, wherein the leveling agent is a compound of formula L1:

$$[B]_n[A]_p \quad \text{(L1);}$$

or the leveling agent is a compound comprising a structural unit of formula L3a or L3b:

(L3a)

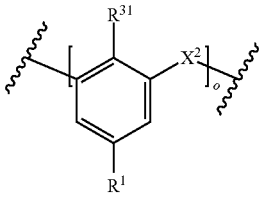

(L3b)

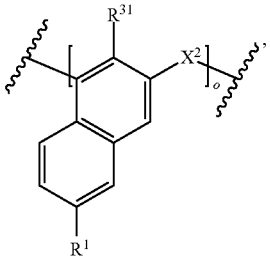

or salts thereof, wherein $R^1$ is selected from the group consisting of $X^1CO—O—R^{11}$, $X^1—SO_2—O—R^{11}$, $X^1—PO(OR^{11})_2$, and $X^1—SO—O—R^{11}$;

$R^{31}$ is selected from the group consisting of $R^1$, H, $OR^{32}$ and $R^{32}$, $R^{32}$ is selected from the group consisting of (i) H and (ii) $C_1$ to $C_6$ alkyl, $X^1$ is a divalent group selected from the group consisting of (i) a chemical bond (ii) aryl, (iii) $C_1$ to $C_{12}$ alkanediyl, which is optionally interrupted by 0 atoms, (iv) arylalkyl group $—X^{11}—X^{12}—$, (v) alkylaryl group $—X^{12}—X^{11}—$, and (vi) $—(O—C_2H_3R^{12})_m—O—$, $X^2$ is (i) a chemical bond or (ii) methanediyl, $R^{11}$ is selected from the group consisting of H and $C_1$ to $C_4$ alkyl, $R^{12}$ is selected from the group consisting of H and $C_1$ to $C_4$ alkyl, $X^{12}$ is a divalent aryl group, $X^{11}$ is a divalent $C_1$ to $C_{15}$ alkanediyl group, A is a co-monomer selected from the group consisting of vinyl alcohol, which is optionally (poly)ethyoxylated, and acrylamide, B is a unit of formula L1a:

(L1a)

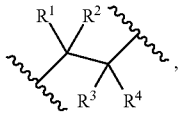

$R^2$, $R^3$, $R^4$ are independently selected from the group consisting of $R^1$ and (i) H, (ii) aryl, (iii) $C_1$ to $C_{10}$ alkyl (iv) arylalkyl, (v) alkylaryl, and (vi) $—(O—C_2H_3R^{12})_m—OH$, wherein if one of $R^2$, $R^3$ or $R^4$ is $R^1$, remaining $R^2$, $R^3$ or $R^4$ are different from $R^1$, n is an integer from 2 to 10,000, m is an integer from 2 to 50, is an integer from 2 to 1000, and p is 0 or an integer from 1 to 10,000, wherein the composition is free of any dispersed particles.

2. The composition according to claim 1, wherein $R^2$, $R^3$ and $R^4$ are selected from the group consisting of H, methyl, ethyl, and propyl.

3. The composition according to claim 1, wherein $R^2$ and either $R^3$ or $R^4$ are selected from the group consisting of H, methyl, ethyl, and propyl, and remaining $R^3$ or $R^4$ is $R^1$.

4. The composition according to claim 1, wherein $R^3$ and $R^4$ are selected from the group consisting of H, methyl, ethyl, and propyl, and $R^2$ is $R^1$.

5. The composition according to claim 1, wherein $R^{11}$ is H.

6. The composition according to claim 1, wherein n+p is an integer from 10 to 5000 and m is an integer from 2 to 30.

7. The composition according to claim 1, wherein the leveling agent is selected from the group consisting of polyacrylic acid, a maleic acid acrylic acid copolymer, an itaconic acid acrylic acid copolymer, polyphosphonic acid, and polysulfonic acid.

8. The composition according to claim 1, wherein $R^1$ is a sulphonate group and $R^{31}$ is OH.

9. The composition according to claim 1, wherein the composition further comprises a suppressing agent selected from the group consisting of a hydroxy alkyne or an amino alkyne.

10. A process for depositing cobalt on a semiconductor substrate comprising a recessed feature having an aperture size below 100 nm, the process comprising (a) bringing a composition according to claim 1 into contact with the semiconductor substrate, (b) applying an electrical potential for a time sufficient to fill the recessed feature with cobalt.

11. A process according to claim 10, comprising: depositing a cobalt seed on a dielectric surface of the recessed feature before the bringing.

12. A process according to claim 10, wherein the recessed feature has an aperture size of 30 nm or below.

* * * * *